US005273505A

United States Patent [19]

Jones

[11] Patent Number: 5,273,505

[45] **Date of Patent: * Dec. 28, 1993**

[54] HIGH ROW EXERCISE MACHINE

[75] Inventor: Gary A. Jones, Falmouth, Ky.

[73] Assignee: Hammer Strength Corporation, Cincinnati, Ohio

[ * ] Notice: The portion of the term of this patent subsequent to Sep. 24, 2008 has been disclaimed.

[21] Appl. No.: 779,947

[22] Filed: Oct. 21, 1991

[51] Int. Cl.[5] ..... A63B 21/08

[52] U.S. Cl. ..... 482/97; 482/133; 482/142

[58] Field of Search ..... 482/97, 134, 92, 93, 482/133, 139, 142; 128/25 R

[56] References Cited

U.S. PATENT DOCUMENTS

| | | | |
|---|---|---|---|
| 3,858,873 | 1/1975 | Jones | 482/97 |
| 3,998,454 | 12/1976 | Jones | 482/139 |
| 3,998,455 | 12/1976 | Jones | 273/29 BD |
| 4,720,099 | 1/1988 | Carlson | 482/133 |
| 5,044,631 | 9/1991 | Jones | 482/93 |
| 5,050,873 | 9/1991 | Jones | 482/93 |

OTHER PUBLICATIONS

Cybex (Strength Systems) p. 2 (Lat Pulldown) Dec. 1989.

The Nautilus Book, by Ellington Darden PhD, Copyright 1982, cover, copyright pg., pp. 102 and 103 The "Compound Position Biceps Machine".

Leverage Machines by Nautilus Brochure.

Nautilus Instruction Manual.

Cybex Brochure.

Leverage Machines by Nautilus, Instruction Manual.

*Primary Examiner*—Richard J. Apley

*Assistant Examiner*—Jerome Donnelly

*Attorney, Agent, or Firm*—Wood, Herron & Evans

[57] ABSTRACT

A high row exercise machine includes a frame symmetrical with respect to a vertical midplane, a seat connected to the frame adapted to support an exerciser along the midplane in a forward facing direction, and a pair of spaced levers pivotally connected to the frame above and behind the seat on opposite sides of the midplane. The levers pivot through vertical planes of motion which converge with respect to the forward facing direction of the seat. Each of the rearward ends of the levers is adapted to hold a selected weight resistance, and each of the forward ends of the levers includes an angled handle located in front of and above the exerciser supported on the seat. An exerciser supported on the seat reaches up and grasps the handles, with palms facing forward, and then pulls downwardly and slightly forwardly in a high row exercise motion to pivot the levers against the selected weight resistances held by the hubs.

20 Claims, 4 Drawing Sheets

HIGH ROW EXERCISE MACHINE

FIELD OF THE INVENTION

This invention relates to weight training exercise equipment. More particularly, this invention relates to an exercise machine for exercising a muscle group which includes the latissimus dorsi, the rhomboids, the posterior deltoids and the biceps through a high row motion.

BACKGROUND OF THE INVENTION

Many athletes and non-athletes utilize weight lifting or weight training exercises to build strength and/or bulk, to prevent injury, or to improve overall condition and appearance. Typically, weight training exercises are performed with either exercise machines or free weights, i.e., barbells and weighted plates, dumbbells, etc. For various reasons, most exercise programs incorporate both machines and free weights in a variety of different exercise routines in order to maximize the effect of working out a desired number of muscle groups.

Free weights offer a number of advantages over exercise machines. For instance, they are relatively inexpensive in comparison to exercise machines. Free weights are also more versatile because a variety of exercises can be performed with one set of weights, whereas most exercise machines are designed for only one exercise. Even though some exercise machines accommodate more than one exercise, the cost of these machines usually increases proportionately with the number of exercises. Use of dumbbells also enables both arms to be exercised independently. Finally, free weights are popular among many weight lifters because the lifting movements are not restricted to prescribed planes of motion or prescribed angles.

Nevertheless, there are also a number of inherent disadvantages associated with free weights. One such disadvantage relates to safety. Although most weight room instructors strongly advise against an individual working out by himself or herself, this cautionary measure is particularly important when the lifting of free weights is involved. This is due to commonly recognized dangers such as the possibility of dropping a weight on a body part, or becoming trapped beneath a bar, which could easily occur in exercises such as bench press, incline press or squat. Additionally, through carelessness, loading and unloading of heavy weighted plates onto the ends of a bar sometimes results in an unbalanced bar that falls downward from its rack.

Another disadvantage associated with some free weight exercises relates to the body positioning required to perform a prescribed maneuver. The location of the weights with respect to the body may be awkward and/or dangerous. Finally, due to gravity, for some movements designed to exercise a muscle group in a particular way, a weight resistance simply cannot be applied against the muscular movement without a machine. Generally, any exercise which requires some downward pulling movement would come under this latter category. One particular pulling exercise movement is referred to as a high row. This movement exercises a muscle group which includes the latissimus dorsi, the rhomboids, the posterior deltoids and the biceps. Starting with arms extended above and in front of the head, with palms pronated, or facing outwardly, the exerciser pulls downwardly and slightly forwardly to a position in front of the chest against a weight resistance applied throughout the motion. The motion is downward and slightly forward, while the applied resistance against this muscle group during the high row motion is directed upwardly and slightly rearwardly. The elbows move outwardly during the pulling motion.

One exercise maneuver which exercises this muscle group through this motion is a relatively close grip pull up performed with palms facing forward and, in an uppermost position, with the head of the exerciser pulled up and facing the bar. During this motion, the weight resistance of the body applies downward force, but there is also some rearward resistance felt by the exerciser, because the torso moves rearwardly as the body is pulled upwardly. With arms extended, the bar is directly above the head. When the body is pulled up, the bar is in front of the head. This movement also requires some outward movement of the elbows during pulling.

While a pull up performed this way may effectively exercise the above-described muscle group, it has a number of limitations. First, many people simply cannot lift their own weight, and this manner of pull up requires that the exerciser be able to lift at least his or her weight. Second, a pull up cannot be easily performed with one hand. One important aspect of weight training involves the isolation of muscle groups on both sides of an exerciser's body, so that the arms or the legs can be exercised independently, or simultaneously, depending on the circumstances. Particularly during rehabilitation, single limb exercise enables an exerciser to measure and compare the relative strength of an injured limb to the strength of the healthy limb, so that rehabilitation progress can be monitored.

Some exercise machines provide a pulley/cable exercise device which includes a pulley restricted bar held at opposite ends and pulled downwardly. This device is commonly referred to as a lat pulldown. A lat pulldown may be used to perform several different pulldown exercises, including a modified high row. This is done by connecting a narrow hand grip to the bar, grasping the grip with palms forward, leaning back and pulling downwardly from above the head to a position in front of the head, from either a seated or a kneeling position. Unfortunately, this manner of performing a high row exercise suffers from a number of deficiencies.

First, the resistance is directed upwardly, or vertical, with no transverse resistance felt by the exerciser. While an exerciser using this device may lean the torso rearward during the pulldown motion, this compound pulling/leaning movement does not apply any transverse resistance to the desired muscle group. In other words, this particular device does not track the natural position of the muscles through the high row motion previously described. Moreover, this machine can only be operated one arm at a time.

Perhaps due to costs, or due to a mistaken perception that the high row exercise motion is relatively unimportant, applicant is unaware of any exercise machine which exercises the high row muscle group in a sufficient manner.

It is an object of the invention to provide an exercise machine which maximizes the muscular benefit attainable during performance of a high row motion by applying resistance against the natural body motion throughout this movement.

It is another object of this invention to provide a high row exercise machine which is particularly suitable for exercising one arm at a time.

It is another object of the invention to provide a high row exercise machine which combines the advantageous features of both free weight exercise and exercise machines without incorporating the attendant disadvantages normally associated therewith.

SUMMARY OF THE INVENTION

This invention contemplates a high row exercise machine which includes a frame, a seat connected to the frame to support an exerciser facing a forward direction and a pair of spaced levers pivotally connected to opposite sides of the frame above and behind the seat. Rearward ends of the levers provide selectable weight resistances for exercising against. The forward ends of the levers include inwardly angled handles adapted to be grasped above the head of the seated exerciser, with the palms directed forwardly and the thumbs pointed inwardly. With the handles grasped, the levers may be pulled downwardly and slightly forwardly to a position in front of the chest in a high row motion, thereby to pivotally raise the respective weighted rearward ends and move the levers through vertical planes which converge with respect to the forward direction.

Because it has two independently pivotal levers, this high row exercise machine enables the performance of either simultaneous or alternate exercise of both arms. This feature is particularly advantageous in monitoring rehabilitation progress after an injury, where it is often necessary to compare the relative strengths of the arms.

In a related aspect of this feature, the levers are substantially balanced, with the weight of the rearward ends being only slightly greater than the forward ends. As a result, for each lever, the total moment about the pivot axis is very low, and the minimum weight that must be exercised against, i.e., with no weight plates supported, is very low. Therefore, and also because the pivotal lever has substantially no friction, the weights supported on the rearward ends of the levers closely approximate the actual weight resistance that is exercised against. This feature becomes important during the initial stages of rehabilitation, when it may be required to exercise against very low weight resistance and keep highly accurate records of actual weight lifted. In short, this machine facilitates the monitoring and measuring of rehabilitation progress through very low weight resistances.

In accordance with a preferred embodiment of the invention, a high row exercise machine includes a frame that is symmetric about a vertical midplane, a seat connected to the frame and adapted to support an exerciser facing a forward direction along the vertical midplane, and a pair of levers pivotally connected to the frame above and behind the seat. Forward ends of the levers extend in front of the seat and include angled handles which are adapted to be grasped and pulled downwardly and slightly forwardly to pivot the levers through planes of motion which converge forwardly toward the vertical midplane. When in an at rest position, the rearward ends of the levers rest against the frame, angled downwardly from horizontal. Each rearward end includes an inwardly directed hub adapted to hold at least one removable weight to enable an exerciser to provide a desired weight resistance for the levers. Each rearward end also includes a stop which rests against the frame when in an at rest position. The initial angle of the at rest position determines the magnitude of the applied resistance felt by the exerciser during initiation and throughout the exercise motion. The angled handles are located above and in front of the head of the exerciser when the levers are in the at rest position. A pair of pads located in front of the seat engages the upper thighs of an exerciser supported on the seat. The pads prevent upward movement of the exerciser during the pulldown motion. Like the seat, the pads are vertically adjustable with respect to the frame to accommodate exercisers of different size.

This high row exercise machine facilitates safe and efficient performance of a high row motion to exercise a muscle group which includes the latissimus dorsi, the rhomboids, the posterior deltoids and the biceps. More importantly, the structural orientation of the frame, including the converging vertical planes of motion through which the levers move, the locations of the pivot points with respect to the seat, the locations of the handles above and in front of the exerciser and the angles of the handles with respect to the exerciser's body all combine to accommodate the natural musculoskeletal make-up of the human body. Thus, this machine enables an exerciser to couple the exertable force against a selected weight resistance in a manner which, compared to a pull up or a modified pulldown exercise performed with a pulley/chain pull-down device, feels more compatible with the natural angles through which the body normally moves during a high row motion.

The use of levers provides a weight resistance which is directed upwardly and slightly rearwardly during the motion. The converging planes of the levers and the handle angles better accommodate the natural muscular position of an exerciser during this motion. As a result, maximum muscular benefits for this muscle group during this motion are achieved with this machine. At the same time, only a minimum amount of joint stress is felt by the joints associated with this muscle group.

The structural orientation of this high row exercise machine evolved from applicant's belief that most exercise machines oversimplify the musculoskeletal movements of the human body. While his accumulated years of observing and analyzing athletic movements of the body led him to conclude that most musculoskeletal movements are rather complex and involve multiple joints and multiple degrees of freedom, he also recognized that most exercise machines require bodily movement in directions or planes that are oriented simply at right angles or parallel to the torso of the body.

Based on these observations, and bolstered by his opinion that the ultimate objective of any exercise machine is to provide maximum muscular benefit with minimum joint stress, applicant perceived a need for improvement in the design of exercise machines and began working toward that goal. Feedback from athletes who have used this inventive high row exercise machine has confirmed that it constitutes a marked improvement over other methods for performing a high row exercise.

This high row exercise machine provides the benefits of both free weight exercise and exercise with weight machines, without incorporating the attendant disadvantages commonly associated with these methods of exercising.

These and other features of the invention will be more readily understood in view of the following detailed description and the drawings in which:

DETAILED DESCRIPTION OF THE DRAWINGS

Figure 1:
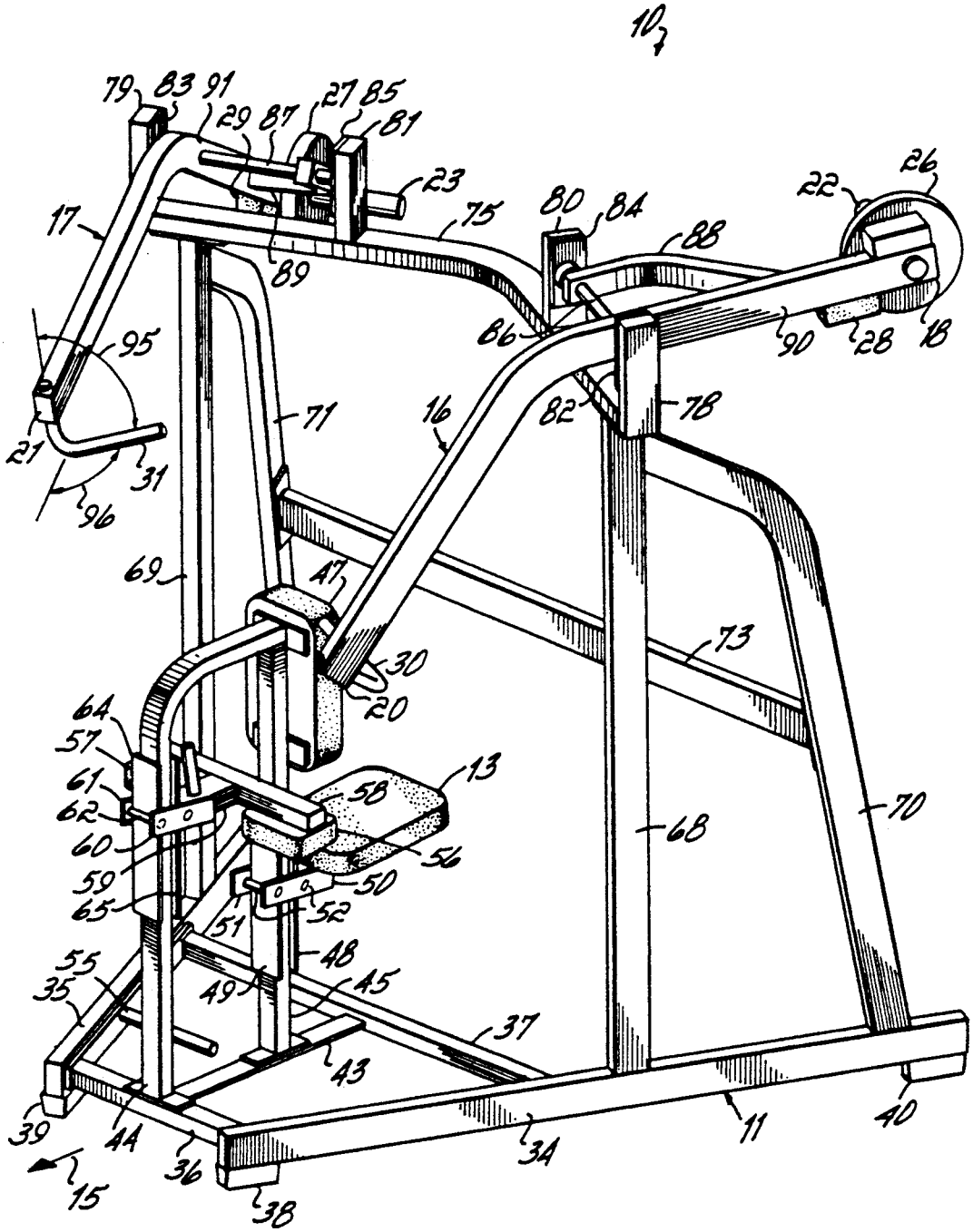
FIG. 1 is a perspective view of a high row exercise machine in accordance with a preferred embodiment of the invention.

FIGS. 1–4 show a high row exercise machine 10 in accordance with a preferred embodiment of the invention. This machine 10 includes a frame 11 made of a number of straight and/or curved sections of heavy duty steel that are either welded or bolted together, or pivotally connected. A seat 13 is connected to the frame 11 along a vertical midplane 14 and adapted to support an exerciser in a forward facing direction indicated by directional arrow 15. Levers designated generally by numerals 16 and 17 ar pivotally connected to the frame 11 above and behind the seat 13. The frame 11 is symmetric with respect to the midplane 14, and the levers 16 and 17 are located on opposite sides of the midplane 14. In describing the details of the machine 10, with respect to forward direction 15, components which are symmetrical with respect to midplane 14 have been numbered so that the even numbered component resides to the left of the midplane 14 and the next higher odd number designates the corresponding symmetric component residing on the right side of the midplane 14.

Each lever has a rearward end and a forward end. Lever 16 includes rearward end 18 and forward end 20. Lever 17 includes rearward end 19 and forward end 21. Each rearward end is equipped with a hub adapted to hold at least one removable weight and a rubber stop adapted to coact with the frame 11 to limit downward pivotal movement of the lever with respect to the frame 11. As shown in FIG. 1, rearward end 18 of lever 16 includes hub 22 for supporting at least one removable weight 26 and stop 28 to coact with frame 11. Forward end 20 of lever 16 includes a handle 30 adapted to be grasped and pulled downwardly by an exerciser supported on the seat 13. Similarly, rearward end 19 of the lever 17 includes hub 23 for supporting at least one removable weight 27 thereon and stop 29. Forward end 21 of lever 17 includes handle 31.

The frame 11 is supported at the bottom by bottom supports 34 and 35 which ar interconnected by front brace 36 and intermediate brace 37. Preferably, front brace 36 and intermediate brace 37 are interconnected to bottom supports 34 and 35 by welded end plates with through holes formed therein for bolted securement to bottom support 34 and 35. Alternately, the end plates could be welded, or the braces could be welded directly to the supports. Bottom support 34 rests on base plates 38 and 40 on the left, and bottom support 35 rests on base plates 39 and 41 on the right. The base plates may be rubber or metal. If metal, the base plates may have holes formed therethrough for securement of the machine 10 to a portable base, or to facilitate safe transport of the machine 10.

A bottom connector 43 extends between front brace 36 and intermediate brace 37. First upright 44 and second upright 45 extend vertically upwardly from front brace 36 and bottom connector 43, respectively. The uprights are supported at their bottom ends by end-welded plates. Near the top, first upright 44 bends rearwardly to connect to the top of second upright 45. Second upright 45 has a chest support 47 mounted thereon for supporting the chest of an exerciser (not shown) during performance of a high row exercise. Two resilient planar pieces 48 and 49 are mounted to rearward and forward surfaces, respectively, of second upright 45. Spaced parallel supports 50 and 51 extend forwardly from under seat 13 and are interconnected by a pair of horizontal spaced rods 52 which fit snugly on opposite sides of the planar pieces 48 and 49.

To raise or lower the seat 13 with respect to upright 45, the forward end of the seat 13 is tilted upwardly with respect to upright 45 so that the spaced parallel bars move away from, or provide clearance from pieces 48 and 49. In this orientation, the seat 13 may be moved upwardly or downwardly along the planar pieces 48 and 49, in a direction parallel to second upright 45. When the forward end is subsequently tilted downwardly, the parallel bars 52 of the seat 13 will frictionally engage the planar pieces 48 and 49 to hold the seat 13 in place. Any number of other methods for providing vertical adjustability for the seat 13 would also be suitable. If desired, the seat 13 could be mounted separately on a post telescoped within a base, with a bolt and pin connection to provide vertical adjustability for the post.

Similarly, the structural components supported on first upright 44 and designated generally by numeral 55 prevent upward movement of an exerciser supported on the seat 13 during a high row exercise. More particularly, pads 56 and 57 are mounted to a cross bar 58 and located in a position in front of the seat 13 to engage the tops of the thighs of an exerciser supported on the seat 13. Cross bar 58 is welded to a middle brace 59 to which vertically oriented, parallel spaced plates 60 and 61 are connected. Horizontal, parallel rods 62 interconnect the forward ends of spaced plates 60 and 61 to engage the forwardly and rearwardly directed surfaces of resilient planar pieces 64 and 65, respectively, which are mounted to the forward and rearward surfaces of first upright 44, respectively. The vertical position of the pads 55 and 57 may be raised or lowered with respect to first upright 44 by manipulating the cross bar 58 and the parallel rods 62, similar to the manner described above for vertically adjusting seat 13 along second upright 45.

On the left side of the midplane 14, front leg 68 and rear leg 70 extend upwardly from bottom support 34. On the right side of the frame 11, front leg 69 and rear leg 71 extend upwardly from bottom support 35. Rear legs 70 and 71 include an intermediate bend adjacent the top ends thereof, prior to connection to rearwardly directed surfaces of front legs 68 and 69, respectively. Rear brace 73 interconnects the rear legs 70 and 71, and top brace 75 extends across the frame 11 between the tops of front legs 68 and 69. Top brace 75 extends slightly beyond each of the front legs 68 and 69. Top brace 75 also supports the work boxes, or the structural components which mount the levers 16 and 17. The top brace 75 includes a centrally located forward bend to accommodate the forward convergence of the sides of the frame 11 and the corresponding forward convergence of the vertical planes through which levers 16 and 17 move.

For each of the levers, the work box includes spaced uprights mounted to and extending upwardly from top brace 75. Uprights 78 and 80 are located on the left side of the midplane 14, while uprights 79 and 81 are located on the right side of midplane 15. Bearings 82 and 84 are mounted to the inward and outward directed surfaces of uprights 78 and 80, respectively. Similarly, bearings 83 and 85 are mounted to the inwardly and outwardly directed surfaces of uprights 79 and 81, respectively. Axle 86 is connected between bearings 82 and 84, and axle 87 is connected between bearings 83 and 85. The axles pivot within the bearings to provide pivotal motion for the levers 16, 17. While any one of a number of different bearings would work, applicant has found that a pillow block bearing sold by Browning, and identified as Part No. VF 2S 116, has proved suitable. These bearings require maintenance only once a year, maintenance which consists of one shot of lubricating oil. Lever 16 includes a reinforcing arm 88 rigidly connected between axle 86 and lever body 90. Similarly, lever 17 includes a reinforcing arm 89 rigidly connected between axle 87 and lever body 91.

Figure 2:
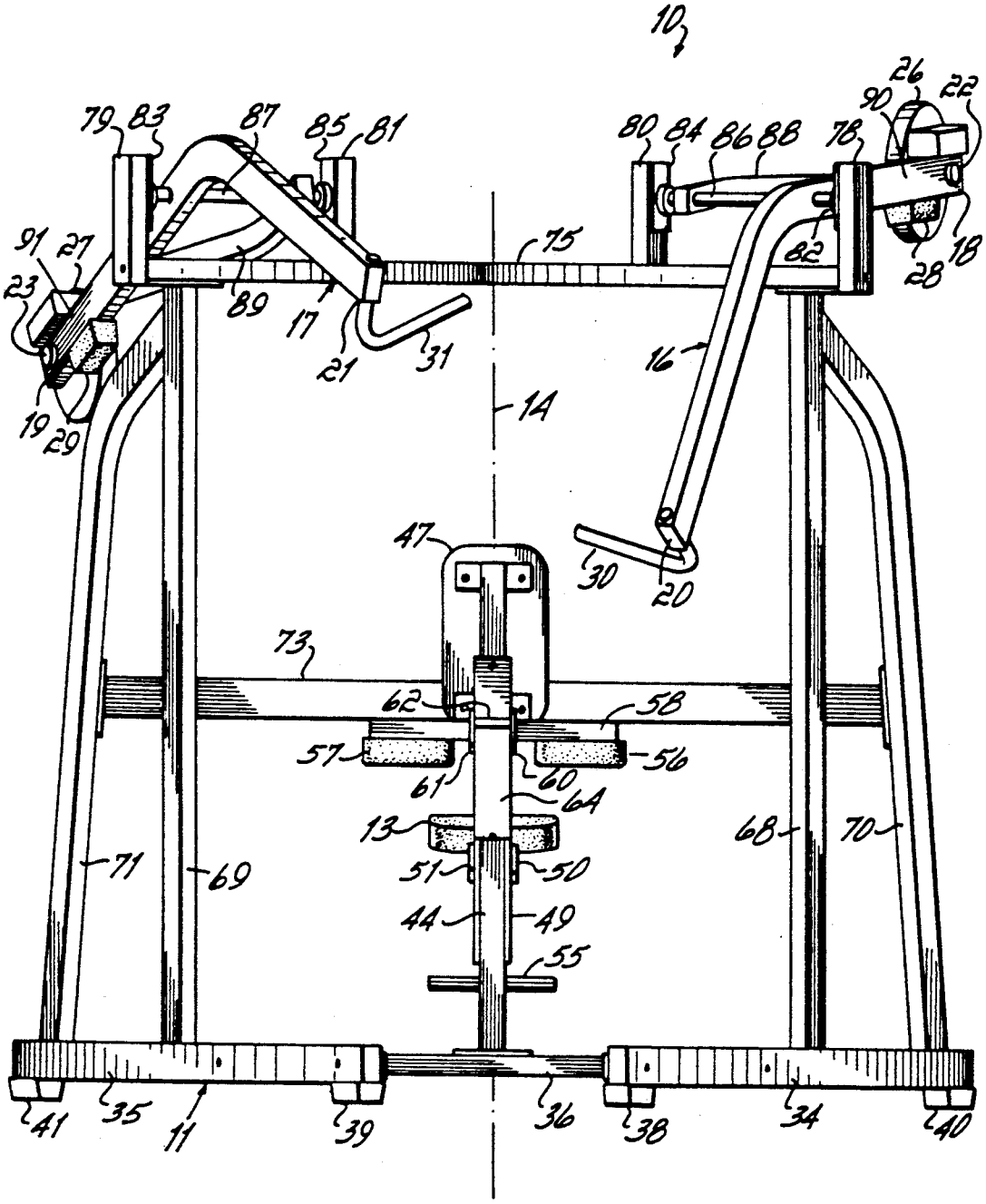
FIG. 2 is a front view, looking forward, of the high row exercise machine shown in FIG. 1.

FIGS. 1 and 2 show the orientation of the handles 30 and 31 with respect to the forward ends 20 and 21, respectively. Each of the handles 30 and 31 is actually a bent metal rod which has been bent to form a first portion which is connected to the forward end of the respective lever body, and a second portion which is grasped by an exerciser supported on the seat 13. The two portions of each handle are separated by an angle of about 112°, an angle designated by numeral 95 in FIGS. 1 and 2. In another manner of reference, the handle portions are bent inwardly about 68° from a 180° straight line. Preferably, the first portions of the handles are received within holes machined in the forward ends of the levers and then welded in place therein. The second portions of the handles are oriented at angles rotated about 84° from the rearward direction of the respective lever body, an angle designated by numeral 96 in FIG. 4.

Figure 3:
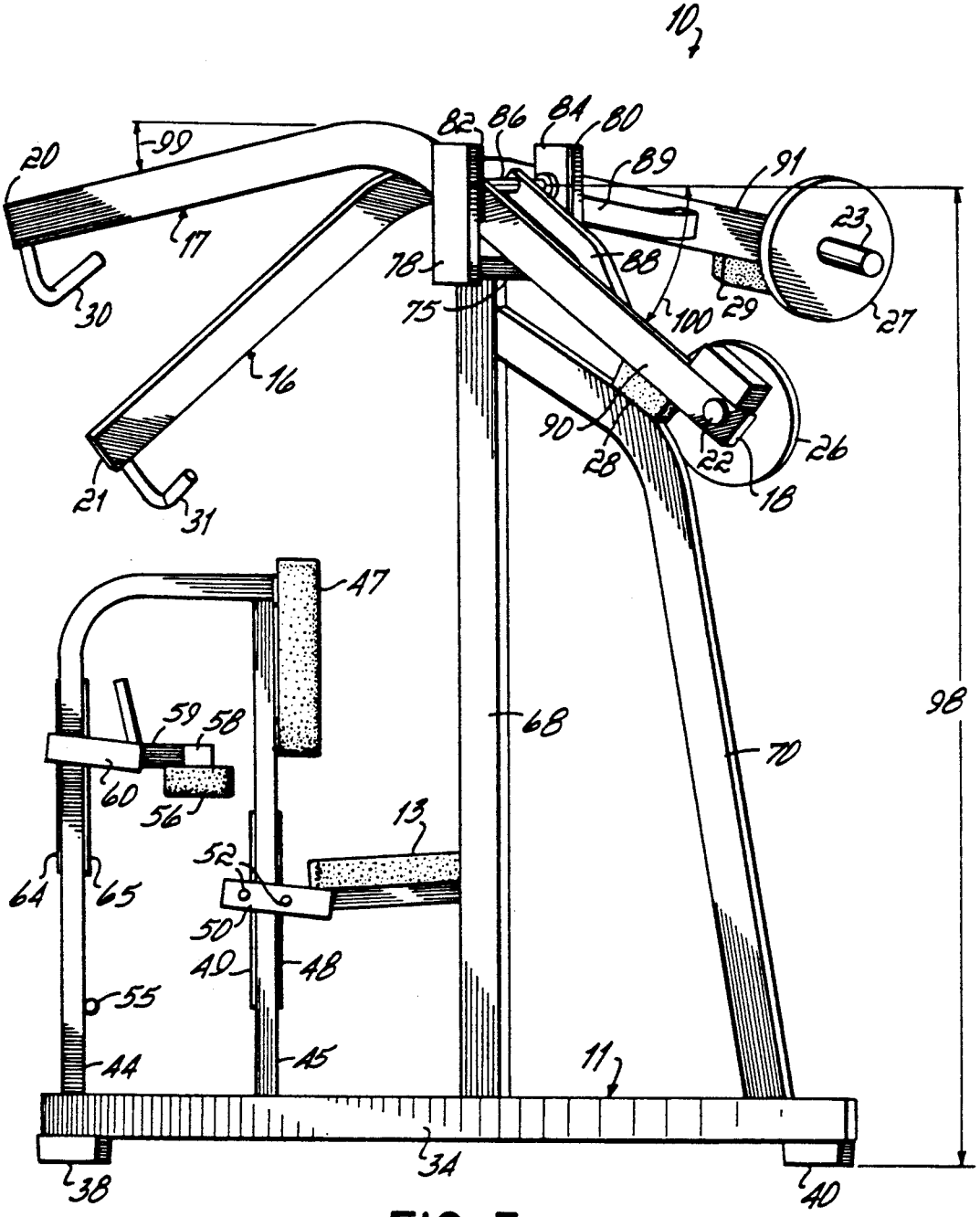
FIG. 3 is a side view of the high row exercise machine shown in FIG. 1, depicting one of the lever arms in an at rest position.

As shown in FIG. 3, numeral 98 designates the vertical distance from the floor to the axle 86, and this distance is preferably about 70". Each lever body has a total length of about 60 ¾". The pivot point of each lever body is located about 27" in front of the rearward end thereof. The distance from the forward end to the center of the bend in the lever body is about 31 ⅝". Due to the weight of the reinforcing arm, the hub and the stops, the rearward end of each lever weighs slightly more than the forward end so that, when at rest, in an initial at rest position, a rearward section the lever body 90 is angled about 40.5° downwardly from horizontal (i.e., 49.5 up from vertical), an angle designated by numeral 100. This locates the forward section of the respective lever body at an angle of about 9.5° downward from horizontal (i.e., 80.5 up from vertical), an angle designated by numeral 99. Combined, in an at rest position, this provides a lever body bend angle between the forward and rearward sections of about 130° (i.e., 49.5°+80.5°).

In operation, an exerciser seated on seat 13, facing direction 15 and with chest pressed against chest support 47, reaches upwardly above the head to grasp handles 30 and 31 of levers 16 and 17, respectively, with palms facing forward. The application of a downward and sightly forward pulling force pivots the levers 16 and 17 with respect to the frame 11 and against the weight resistances held by rearward ends 18 and 19, respectively. Through this motion, the elbows move slightly outwardly. The location of the pivot point, the bend in the lever body and the respective lengths of the forward and rearward sections of the levers provide a pivotal lever which is, initially, relatively easy to pivot. Pivotal pulling increases in difficulty throughout the pulling motion.

Figure 4:
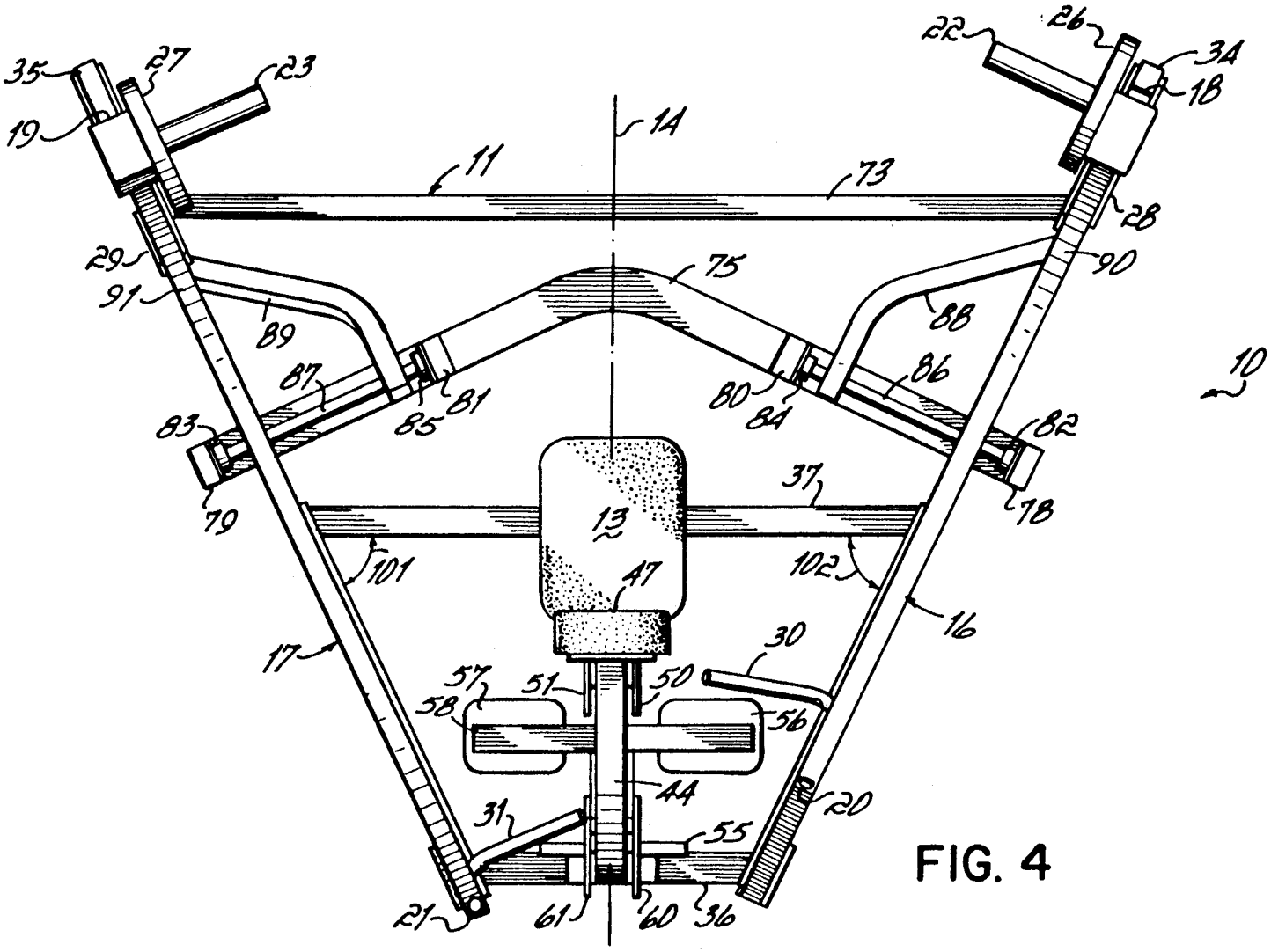
FIG. 4 is a plan view of the high row exercise machine shown in FIG. 1.

As shown best in FIG. 4 with respect to forward direction 15, the sides of the frame 11 converge toward vertical midplane 14. This forward convergence is designated by numeral 101 on the left and by numeral 102 on the right, and this angle of forward convergence is preferably about 25°. These angles correspond to the forward convergence of the vertical planes through which the levers move.

As mentioned previously, frame 11 enables a person to perform a high row exercise, either simultaneously with both arms or independently, a feature which is particularly desirable for rehabilitation.

While a preferred embodiment of the invention has been described, it is to be understood that the invention is not limited thereby and that in light of the present disclosure various other alternative embodiments will be apparent to a person skilled in the art. For instance, the structural orientation of some parts or portions of the frame 11 is not critical, so long as the position of the lever pivot axes, the lever lengths, the handles, and the converging vertical planes through which the levers rotate are maintained. Additionally, while the particular angles of the sides of the frame 11 and the handle angles shown are considered to be optimum at the present time, based upon feedback from those involved in strength training, it is entirely possible that some further refinements may evolve. Accordingly, it is to be understood that some modification may be made without departing from the scope of the invention as particularly set forth and claimed.

In the claims:

1. A high row exercise machine comprising:

a frame;

a seat supported within the frame along a vertical midplane and adapted to support an exerciser in seated position facing a forward direction; and a lever pivotally connected to the frame above and behind the seat, the lever having a rearward end adapted to hold a selectable weight resistance means and a forward end extending forwardly in front of the seat and adapted to be grasped and pulled downwardly against the force of a selected weight resistance means in a high row motion by an exerciser while supported on the seat, with the palm of the exerciser facing in the forward direction and the thumb directed toward the vertical midplane, thereby to pivotally move the lever along and through a vertical plane which converges with respect to the forward facing direction of the seat.

2. The high row exercise machine of claim 1 wherein the lever plane converges with respect to the forward facing direction of the seat at an angle of about 25°.

3. The high row exercise machine of claim 1 and further comprising:

a handle connected to the forward end of the lever, the handle extending inwardly from the forward end at an angle that is non-perpendicular with respect to the converging lever plane of motion.

4. The high row exercise machine of claim 3 wherein, in an at rest position, the handle extends inwardly and upwardly with respect to the forward end of the lever.

5. The high row exercise machine of claim 1 and further comprising:

a chest support for supporting the chest of an exerciser seated on the seat and facing the forward direction.

6. The high row exercise machine of claim 1 and further comprising:

means for adjusting the vertical position of the seat with respect to the frame.

7. The high row exercise machine of claim 1 and further comprising:

means for restricting upward movement of the seated exerciser during pivotal movement of the lever.

8. The high row exercise machine of claim 7 wherein said restricting means further comprises:

a pair of spaced, downwardly directed pads located on opposite sides of the vertical midplane, the pads adapted to engage against portions of the upper thighs of an exerciser supported on the seat and facing a forward direction.

9. The high row exercise machine of claim 8 and further comprising:

means for vertically adjusting the position of the spaced pads with respect to the frame.

10. The high row exercise machine of claim 1 and further comprising:

another lever pivotally connected to the frame on an opposite side of the vertical midplane, the levers being symmetrical to each other with respect to the vertical midplane, thereby to provide simultaneous exercise of both sides of an exerciser's body through a high row motion using both arms and alternate high row exercise using only one arm at a time.

11. A high row exercise machine comprising:

a frame symmetrical with respect to a vertical midplane;

a seat supported by the frame along the vertical midplane and adapted to support an exerciser in a forward facing direction; and a pair of spaced levers pivotally connected to the frame on opposite sides of the vertical midplane above and behind the seat, each lever having a rearward end adapted to hold a selectable weight resistance and a forward end adapted to be grasped and pulled downwardly against a selected weight resistance through a high row motion by an exerciser while supported on the seat, with the palms of the exerciser facing in the forward direction and the thumbs directed toward the vertical midplane, the levers adapted to pivot through vertical planes of motion which converge with respect to the forward facing direction of the seat.

12. The high row exercise machine of claim 11 wherein each lever further comprises:

a hub located at a respective rearward end, the hub adapted to hold at least one removable weight.

13. The high row exercise machine of claim 11 and further comprising:

a pair of handles, each handle located at a forward end of a respective lever, each handle angled inwardly from the respective converging lever plane of motion and at an angle non-perpendicular thereto.

14. The high row exercise machine of claim 11 wherein each lever pivots through a vertical plane which converges forwardly at an angle of about 25 .

15. The high row exercise machine of claim 11 and further comprising:

a chest support mounted in vertical orientation in front of the seat; and means for vertically adjusting the position of the seat with respect to the chest support.

16. The high row exercise machine of claim 11 further comprising:

means for restricting upward movement of an exerciser supported on the seat during high row pull-down of the levers.

17. The high row exercise machine of claim 16 and further comprising:

means for vertically adjusting the position of the restricting means with respect to the frame.

18. The high row exercise machine of claim 11 wherein each lever includes a forward and a rearward section and an intermediate bend located therebetween and forward of the respective pivot axis, whereby, in an initial at rest position, each rearward section is angled downwardly from horizontal at an angle of about 40.5° and each forward section is angled downwardly at an angle of about 9.5° from horizontal.

19. The high row exercise machine of claim 18 and further comprising:

a pair of stops, each of the stops mounted proximate the rearward end of a respective lever and adapted to coact with the frame to limit downward pivotal movement of the respective rearward end.

20. A high row exercise machine comprising:

a frame symmetrical about a vertical midplane;

exerciser support means positioned proximate a center of the frame to locate an exerciser along the midplane in a forward facing direction;

a pair of space high row exercise means located on opposite sides of the midplane, each high row exercise means including a forward end handle adapted to be grasped and pulled downwardly and slightly forwardly in a high row motion against a selected weight resistance by an exerciser while engaging the exercise support means, with the palms of the exerciser facing in the forward direction and the thumbs directed toward the vertical midplane, thereby to pivot each respective high row exercise means about a pivot axis located above and behind the seat, each high row exercise means adapted to be pivoted against the respective selected weight resistance through a vertical plane of motion which converges with respect to the forward facing direction.

* * * * *

UNITED STATES PATENT AND TRADEMARK OFFICE

CERTIFICATE OF CORRECTION

PATENT NO. : 5,273,505

DATED : December 28, 1993

INVENTOR(S) : Gary A. Jones

It is certified that error appears in the above-indentified patent and that said Letters Patent is hereby corrected as shown below:

Column 5, Line 25, "ar" should read

--are--.

Column 5, Line 53, "ar" should read --are--.

Column 7, Line 54, "80.5" should read --80.5°--.

Column 10, Line 8, "25" should read --25°--.

Column 10, Line 43, "space" should read

--spaced--.

Signed and Sealed this

Thirty-first Day of October 1995

*Attest:*

*Attesting Officer*

Bruce Lehman

BRUCE LEHMAN

*Commissioner of Patents and Trademarks*